US007067757B1

(12) United States Patent
Chadha

(10) Patent No.: US 7,067,757 B1
(45) Date of Patent: Jun. 27, 2006

(54) MULTI-TIER KEYPAD ASSEMBLY

(75) Inventor: Lovleen Chadha, San Diego, CA (US)

(73) Assignee: Siemens Communications Inc., Boca Raton, FL (US)

( * ) Notice: Subject to any disclaimer, the term of this patent is extended or adjusted under 35 U.S.C. 154(b) by 0 days.

(21) Appl. No.: 11/015,086

(22) Filed: Dec. 17, 2004

(51) Int. Cl.
*H01H 1/10* (2006.01)

(52) U.S. Cl. ..... 200/512; 200/344; 200/5 A; 400/472; 345/168

(58) Field of Classification Search ..... 200/5 A, 200/512–517, 341, 406, 5 R; 341/22; 345/168, 345/169; 400/472, 490, 491.2, 495, 495.1
See application file for complete search history.

(56) References Cited

U.S. PATENT DOCUMENTS

| | | | | |
|---|---|---|---|---|
| 3,796,843 | A | 3/1974 | Durkee et al. | 200/5 A |
| 3,808,384 | A | 4/1974 | Boulanger | 200/5 A |
| 3,831,063 | A | 8/1974 | Keough | 317/101 D |
| 3,893,235 | A | 7/1975 | Keough | 29/628 |
| 4,074,088 | A | 2/1978 | Keough et al. | 200/5 A |
| 4,125,934 | A | 11/1978 | Keough et al. | 200/5 R |
| 5,717,176 | A | 2/1998 | Dahlstrom | 200/1 B |
| 6,180,895 | B1 | 1/2001 | Hutchison et al. | 200/5 A |
| 6,274,825 | B1 * | 8/2001 | Aaltonen et al. | 200/5 A |
| 6,303,887 | B1 | 10/2001 | Ando | 200/512 |
| 6,614,905 | B1 | 9/2003 | Kristensen | 379/368 |
| 6,670,893 | B1 * | 12/2003 | Svarfvar | 341/22 |
| 6,680,676 | B1 * | 1/2004 | Hayashi et al. | 341/22 |
| 6,744,890 | B1 * | 6/2004 | Le et al. | 379/433.07 |
| 2003/0160712 | A1 | 8/2003 | Levy | 341/22 |
| 2004/0005183 | A1 | 1/2004 | MacFarlane | 400/472 |

* cited by examiner

*Primary Examiner*—Lincoln Donovan
*Assistant Examiner*—Lheiren Mae Anglo

(57) ABSTRACT

A multi-tier keypad includes at least a first circuit board having a first circuit and a second circuit board having a second circuit, wherein the second circuit board is disposed adjacent to the first circuit board, one or more first key assemblies for providing input to the first circuit when a first key assembly is pressed and one or more second key assemblies for providing input to the second circuit when a second key assembly is pressed. Apertures are formed through the first circuit board. These apertures allow the second key assemblies to extend through the first circuit board for providing input to the second circuit.

23 Claims, 5 Drawing Sheets

MULTI-TIER KEYPAD ASSEMBLY

BACKGROUND OF THE INVENTION

The present invention relates generally to keypads for electronic devices, particularly hand-held electronic devices such as mobile telephones, palmtop computers, personal digital assistants (PDA's), or the like, and more specifically, to a multi-tier keypad assembly for such electronic devices.

Electronic devices, particularly hand-held electronic devices such as mobile telephones, palmtop computers, personal digital assistants (PDA's), and the like, comprise a class of devices typically requiring an operator to input information via a keypad, such as a numeric keypad, a small alphanumeric keypad, or the like. The keypad may be used for entering alphanumeric text and common commands, selecting menus to be displayed by a display, or the like. The keypad generally includes a set of keys contacting domes disposed over a circuit board. As the keys are pressed, they deform or compress the domes, providing input to the circuit board and tactile feedback to the operator of the electronic device. The amount of tactile feedback provided by the keys is described by the bounce performance of the keypad.

The trend toward miniaturization of electronic devices creates the need for smaller keypads. Further, the increasing complexity of operations required by such electronic devices creates the need for keypads having more keys, including keys having specialized characters and/or functionality. However, as more keys are packaged in smaller spaces, the keys become more concentrated or dense and the distances between the keys decrease, limiting the potential size of domes for providing tactile feedback when a key is pressed and reducing bounce performance. Moreover, a greater concentration of keys may hinder an operator from easily pressing a desired key, as the spaces between the keys become smaller than the width of a typical human fingertip.

Consequently, it would be desirable to provide a keypad having a high key density without loss of mechanical bounce performance. Further, it would be desirable to provide a keypad having multiple sets of keys which are differentiable from one another by adjusting the height of one or more of the sets of keys when keys of that set are to be used.

SUMMARY OF THE INVENTION

Accordingly, the present invention is directed to a multi-tier keypad capable of providing high key density without suffering a substantial loss of mechanical bounce performance. The keypad may also provide multiple sets of keys (e.g., numeric, alphabetic) which are differentiable from one another by adjusting the height of one or more of the sets of keys when keys of that set of keys are to be used for entering information.

In exemplary embodiments, the keypad includes a first circuit board having a first circuit and a second circuit board having a second circuit, wherein the second circuit board is disposed adjacent to the first circuit board (e.g., beneath the first circuit board), one or more first key assemblies for providing input to the first circuit when a first key assembly is pressed and one or more second key assemblies for providing input to the second circuit when a second key assembly is pressed. One or more apertures are formed though the first circuit board. These apertures allow the second key assemblies to extend through the first circuit board for providing input to the second circuit.

The keypad may further include two or more domes disposed over the first and second circuit boards, which are compressed by the first and second key assemblies for providing input to the first and second circuits, respectively. The first and second key assemblies may each comprise a key and a stalk coupled to the key which engage the domes for compressing the domes when the keys are pressed. Preferably, the stalks of the second key assemblies extend through the apertures formed in the first circuit board. In this manner, the size of the domes may be maximized, providing high key density without suffering a substantial loss of mechanical bounce performance.

In specific embodiments, the second circuit board may be movable between a first position relative to the first circuit board for positioning the keys of the second key assemblies at a first height relative to the keys of the first key assemblies and a second position relative to the first circuit board for positioning the keys of the second key assemblies at a second height relative to the keys of the first key assemblies. In this manner, the keypad may provide multiple sets of keys which are differentiable from one another by key height.

The multi-tier keypad may be utilized for providing input to an electronic device such as a mobile telephone, a palmtop computer, a personal digital assistant (PDA), or the like. In specific embodiments, the electronic device may include an actuator assembly coupled to the second circuit board for moving the second circuit board between the first and second positions, thereby raising and lowering the keys of the second key assemblies with respect to the keys of the first key assemblies.

It is to be understood that both the foregoing general description and the following detailed description are exemplary and explanatory only and are not necessarily restrictive of the invention claimed. The accompanying drawings, which are incorporated in and constitute a part of the specification, illustrate embodiments of the invention and together with the general description, serve to explain the principles of the invention.

DETAILED DESCRIPTION OF SPECIFIC EMBODIMENTS

Figure 1:
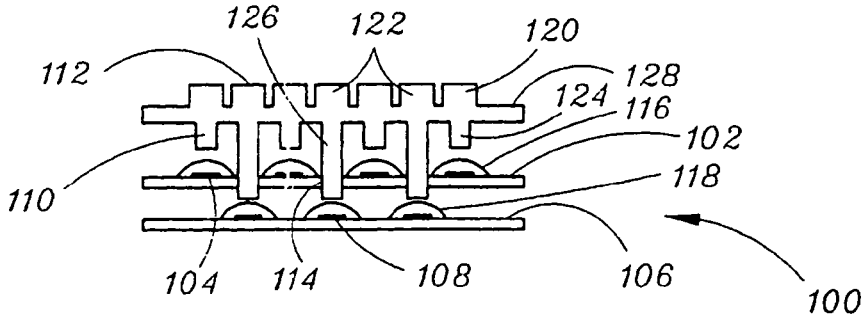
FIG. 1 is a diagrammatic cross-sectional elevation view illustrating a multi-tier keypad in accordance with an exemplary embodiment of the present invention.

Reference will now be made in detail to the presently preferred embodiments of the invention, examples of which are illustrated in the accompanying drawings.

FIGS. 1 through 9 illustrate keypads 100 in accordance with exemplary embodiments of the present invention. Each keypad 100 includes a first circuit board 102 having a first circuit 104 and a second circuit board 106 having a second circuit 108. The second circuit board 106 is positioned so that it is adjacent to the first circuit board 102. For example, in the embodiments illustrated, the second circuit board 106 is positioned beneath and at least substantially parallel to the first circuit board 102. First and second key assemblies 110 and 112 provide input to the first circuit 104 and second circuit 108, respectively, when one of the first or second key assemblies 110 or 112 is pressed by a user. Apertures 114 formed though the first circuit board 102 allow the second key assemblies 112 to extend through the first circuit board 102 for providing input to the second circuit 108.

The keypad 100 further includes a plurality of key domes 116 and 118 positioned on the first and second circuit boards 102 and 106 over portions of the first and second circuits 104 and 108. The key domes 116 and 118 are compressed by the first and second key assemblies 110 and 112 for providing input to the first and second circuits 104 and 108, respectively. Each of the first and second key assemblies 110 and 112 comprise a generally flattened key 120 and 122 and a stalk or post 124 and 126 coupled to and extending downward from the key 120 and 122 which engages a respective one of the domes 116 and 118 for compressing the dome 116 and 118 when the key is pressed. The stalks 126 of the second key assemblies 112 are elongated compared to the stalks 124 of the first key assemblies 110 and extend through the apertures 114 formed in the first circuit board 102. For example, when the keypad 100 is utilized for providing input to an electronic device such as a mobile telephone, or the like, a specific key 120 or 122 may be labeled with a letter or a number (e.g. the number "2"), and the number "2" key may be pressed by an operator in the course of inputting a telephone number to the mobile telephone via the keypad 100. By pressing the number "2" key 120 or 122, a circuit of the first circuit board 102 or the second circuit board 106 is completed when the stalk 124 or 126 of the key assembly 110 or 112 containing of the number "2" key 120 or 122 depresses or collapses the key dome 116 or 118 associated with that key assembly 110 or 112 contacting the circuit 104 or 108 on the circuit board 102 or 106 actuating the circuit (e.g., closing the circuit 104 or 108). Completion of the circuit 104 or 108 formed upon the circuit board 102 or 106 indicates that the key has been pressed.

In exemplary embodiments, each key dome 116 and 118 may be formed of a metal such as a spring steel; an elastomeric material such as a synthetic rubber or plastic, having a metal contact formed therein; or the like. When compressed, the key dome 116 and 118 closes the circuit 104 and 108 for registering a key press. However, those of skill in the art will appreciate that various equipage may be utilized for completing the circuit formed upon the first circuit board 102 or the second circuit board 106 without departing from the scope and intent of the present invention. For example, instead of key domes, an electrically conductive material may be coupled to the end of the stalk 124 or 126 for directly contacting the first circuit board 102 or the second circuit board 106. A spring may be used for returning the key assembly to a non-pressed position. Similarly, the circuit 104 and 108 may employ capacitive coupling, force sensing (e.g., via a force sensor), or like technologies for registering a key press when the dome is compressed. Such technologies are known in the art.

The first and second key assemblies 110 and 112 are formed as part of one or more key mats 128, 130 and 132. For example, in the embodiment shown in FIG. 1, the first and second key assemblies 110 and 112 are formed as part of a single key mat 128. The first and second key assemblies 110 and 112 are spaced though the key mat 128 in an alternating fashion. The first circuit board 102 and the second circuit board 106 which may comprise printed circuit boards (PCBs), associated support structures, or the like, are positioned below the key mat 128. In other embodiments, as shown in FIGS. 2 through 5, a first key mat 130 may include only first key assemblies 110, while a second key mat 132 includes only second key assemblies 112. The second key mat 132 is positioned between the first circuit board 102 and the second circuit board 106, which as in the embodiment in FIG. 1, may comprise printed circuit boards (PCBs), associated support structures, or the like. Apertures 134 are formed in the first key mat 130 through which the second keys 122 of the second key assemblies 112 extend. The key mats 128, 130 and 132 shown in FIGS. 1 through 5 may be formed from an elastomeric polymer, and each key 120 may be formed as a raised portion sized and shaped for being pressed by an operator's finger. Alternatively, the first and second key assemblies 110 and 112 may comprise independent structures (i.e., not joined together as part of a key mat) held within a frame of the keypad 100. Such alterations in the illustrated embodiments would not depart from the scope and intent of the present invention.

In the embodiment shown in FIG. 1, the first and second key assemblies 110 and 112 are formed as part of a single key mat 128. The first circuit board 102 is positioned beneath the key mat 128. The second circuit board 106 is positioned beneath the first circuit board 102. The stalks 126 of the second key assemblies 112 extend through the apertures 114 formed in the first circuit board 102 for providing input to the second circuit board 106. In this embodiment, the second circuit board 106 receives input from the key mat 128 via the second key assemblies 112 in the same manner as the first circuit board 102 receives input from the key mat 128 via the first key assemblies 110.

The multi-tier arrangement of the first and second circuit boards 102 and 106 allows the individual key domes 116 and 118 to be made larger (e.g., to have a greater diameter, width, height, and/or surface area) than would be possible with conventional single-circuit board keypads having similar key densities. For example, as shown in FIG. 1, the key domes 116 and 118 are illustrated as having a diameter $d_d$ that is greater than the thickness or diameter $d_k$ of the key 120 and 122 of the key assembly 110 and 112 associated with that key dome 116 and 118. In the specific embodiment shown, the key domes 116 and 118 extend into the footprint of neighboring keys 120 or 122 (i.e., extend beneath the neighboring keys 120 or 122). Additionally, the key domes 116 and 118 may be made more robust, having walls of greater thickness or walls having improved shapes and/or cross-sections (e.g., ridges, bulges, channels, grooves, or the like), than would be possible in smaller key domes. Typically, larger, more robust key dome structures provide improved mechanical bounce characteristics or properties. However, the mechanical bounce properties of a keypad design may also depend on other design features such as the type of material selected for use in fabricating the key domes, the shape of the key assemblies, the size of the key assemblies, and the like. Thus, by allowing the key domes 116 and 118 of a given keypad layout to be made larger or more robust than would otherwise be possible, the present invention provides the keypad designer with greater flexibility in the design and layout of the keypad 100, while maintaining desired mechanical bounce properties.

In the embodiment illustrated in FIGS. 2 through 5, the first key mat 130 includes only first key assemblies 110, while a second key mat 132 includes only second key assemblies 112. The first key mat 130 is coupled to the first circuit board 102 so that the first key mat 130 is generally held at a distance from the first circuit board 102. Similarly, the second key mat 132 is coupled to the second circuit board 106 so that the second key mat is held at a distance from the second circuit board 106. The second key mat 132 is positioned between the first circuit board 102 and the second circuit board 106. Apertures 134 through which the keys 122 of the second key assemblies 112 extend are formed in the first key mat 130. In this embodiment, the first circuit board 102 receives input from the first key mat 130 the first key assemblies 110 and the second circuit board 106 receives input from the second key mat 132 the second key assemblies 112.

Figure 2:
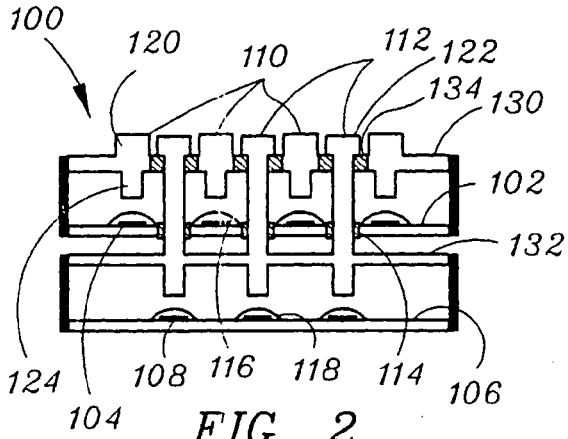
FIG. 2 is a diagrammatic cross-sectional elevation view illustrating a multi-tier keypad in accordance with a second exemplary embodiment of the present invention.
Figure 3A:
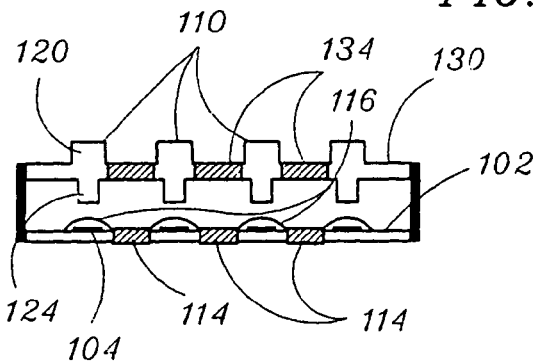
FIG. 3A is a diagrammatic cross-sectional elevation view further illustrating a first set of key assemblies and a first circuit board of the keypad shown in FIG. 2.
Figure 3B:
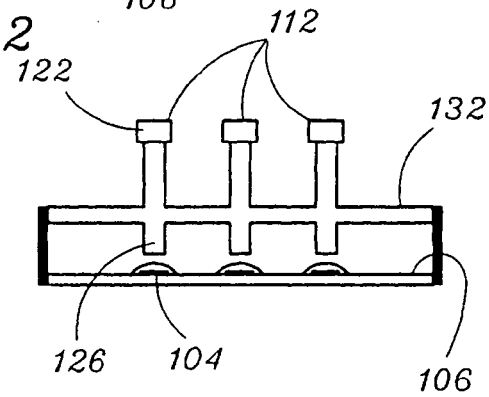
FIG. 3B is a diagrammatic cross-sectional elevation view further illustrating the second set of key assemblies and a second circuit board for the keypad shown in FIG. 2.
Figure 4:
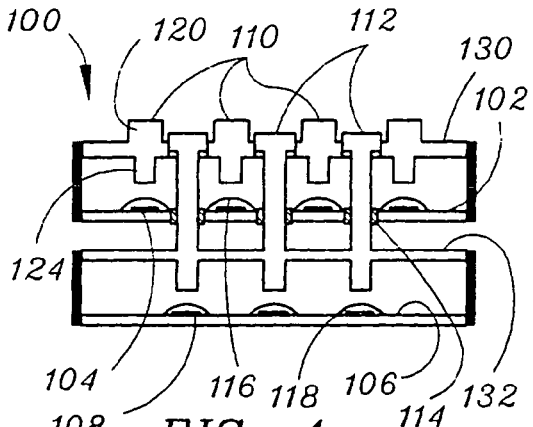
FIG. 4 is a diagrammatic cross-sectional end elevation view of the keypad illustrated in FIG. 2, wherein the first set of key assemblies extends above the second set of key assemblies.
Figure 5:
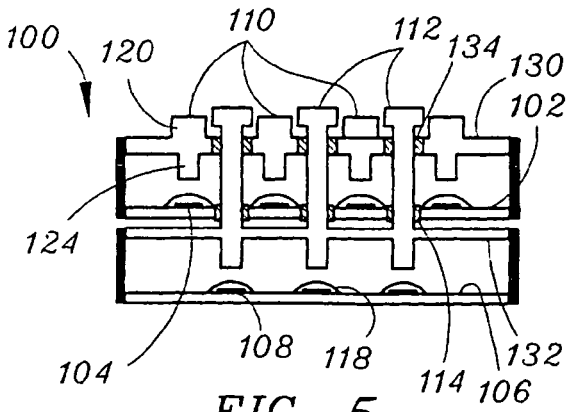
FIG. 5 is a diagrammatic cross-sectional end elevation view of the keypad illustrated in FIG. 3, wherein the second set of key assemblies raised above the first set of key assemblies.
Figure 6:
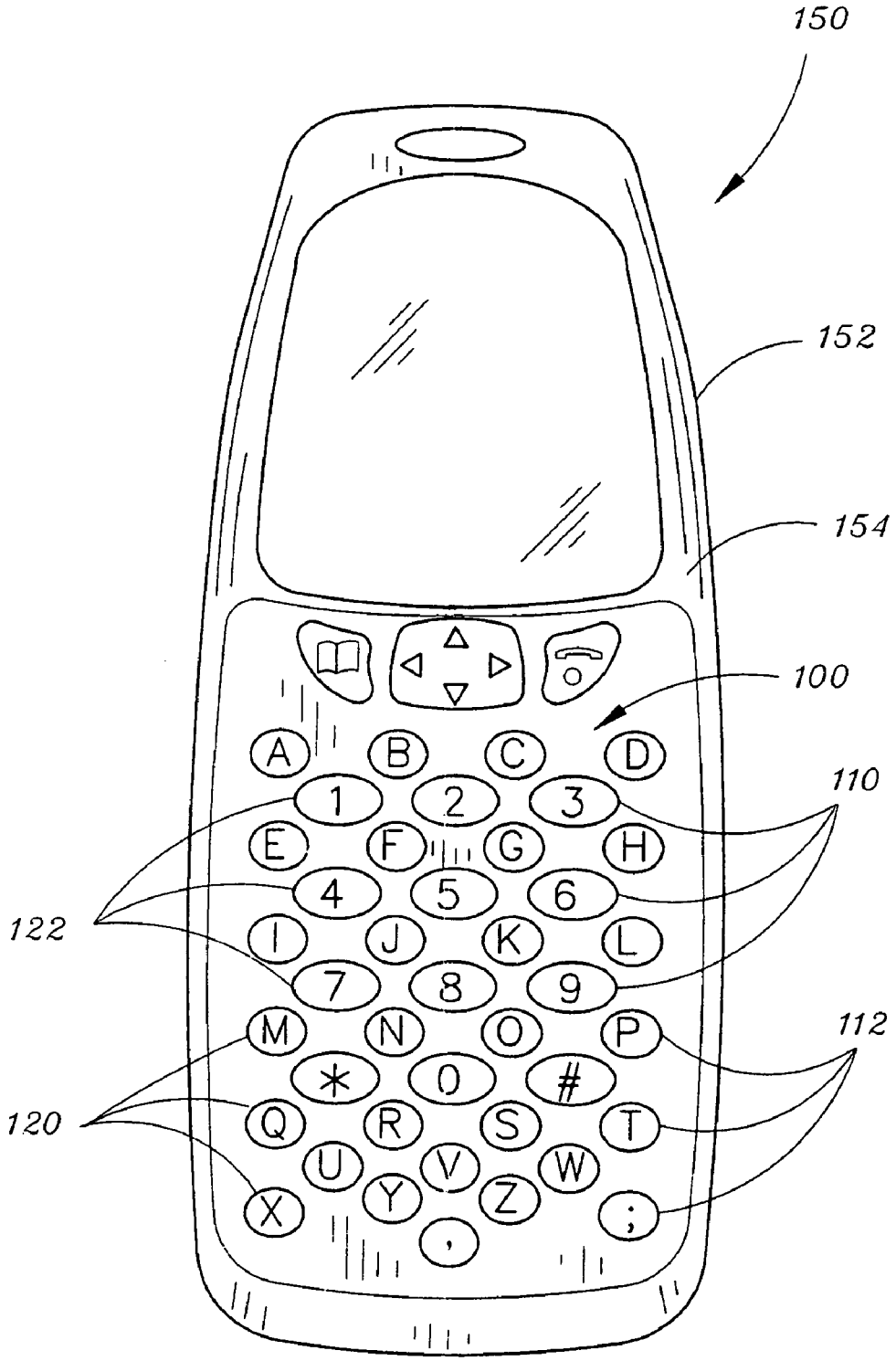
FIG. 6 is a top plan view illustrating a hand-held electronic device, specifically a mobile telephone, having a multi-tier keypad in accordance with an exemplary embodiment of the present invention.

As in the embodiment illustrated in FIG. 1, the multi-tier arrangement of the first and second circuit boards 102 and 106 in the embodiment shown in FIGS. 2 through 5, allows the individual key domes 116 and 118 to be made larger and/or more robust than would be possible with conventional single-circuit board keypads having similar key densities, providing the keypad designer with greater flexibility in the design and layout of the keypad 100, while maintaining desired mechanical bounce properties. Additionally, in exemplary embodiments, the relative heights of the set of first keys 120 and the set of second keys 122 may be varied by allowing one or both of the first circuit board 102 (and the first key mat 130 coupled thereto) and the second circuit board 106 (and the second key mat 132 coupled thereto) to move relative to the one another. For instance, as illustrated in FIG. 2, the sets of first and second keys 120 and 122 may be placed at the same relative height by moving the second circuit board 106 and the second key mat 130 to a first position relative to the first circuit board 102. The set of first keys 120 may be positioned above the set of second keys 122 by moving the second circuit board 106 and the second keymat 132 away from the first circuit board 102 (e.g., downward) to a second position relative to the first circuit board 102, as shown in FIG. 4. Similarly, the set of first keys 120 may be positioned below the second set of keys 122 by moving the second circuit board 106 and the second keymat 132 toward the first circuit board 102 (e.g., upward) to a third position relative to the first circuit board 102, as shown in FIG. 5. It will be appreciated that the first circuit board 102 may also be movable relative to the second circuit board 106, or both the first and second circuit boards 102 and 106 may be movable relative to one another without departing from the scope and intent of the present invention.

By allowing the sets of keys 120 and 122 to be positioned at varying relative heights, increased access may be provided to one set of keys 120 or 122, while limiting inadvertent activation of the other set of keys 122 or 120. For example, in an electronic device such as a mobile telephone or the like, the set of first keys 120 may comprise a numeric keypad having keys for the numbers zero ("0") through nine ("9") and operands such as an asterisk ("*") and an octothorpe ("#"), while the set of second keys 122 may comprise an alphabetic keypad having keys for the letters "A" through "Z" and various punctuation symbols (e.g., a period ("."), a comma (",") or the like). When an operator of the device wishes to input numeric information (e.g., a telephone number), the set of second keys 122 may be positioned below the set of first keys 120. In this manner, the numeric keys of the set of first keys 120 are more easily accessed, while the alphabetic keys of the set of second keys 122 are recessed to prevent inadvertent actuation. Conversely, when the operator wishes to input alphabetical information (e.g., text for text messaging), the set of second keys 122 may be positioned above the set of first keys 120. Should the operator wish to enter alphanumeric information, the sets of first and second keys 120 and 122 may be placed at the same level. Those of ordinary skill in the art will appreciate that keys for other characters such as other punctuation marks, parenthetical marks, symbols, abbreviations, characters from other languages, and the like, may be included with the sets of first and/or second keys 120 and 122. Further, the use of keys having other functionalities, such as keys comprising a directional keypad, a menu button, or the like, would not depart from the scope of the present invention.

FIGS. 1 through 5 illustrate keypads 100 employing two circuit boards 102 and 106 positioned in a two tier arrangement. It is contemplated that the keypads 100 in accordance with the present invention may further employ more than two circuit boards arranged in one or more additional tiers beneath the second circuit board 106. In such embodiments, apertures may be formed in the second circuit board 106 and through circuit boards positioned in subsequently deeper tiers through which one or more of the key assemblies may extend.

In exemplary embodiments, the keypad 100 of the present invention may be utilized for providing input to an electronic device such as the mobile telephone 150 shown in FIGS. 6 through 9. The mobile telephone 150 includes a housing 152 having an upper face 154 and a rear face 156. Preferably, the housing 152 is sized to be held within the hand of a user of the mobile telephone 150. In the specific embodiment illustrated, the keypad 100 includes a set of first keys 120 comprising the numbers zero ("0") through nine ("9"), an asterisk ('*'), and an octothorpe ('#'), arranged in a conventional numeric (telephone) key layout, while the set of second keys 122 comprises an alphabetic keypad having keys for the letters "A" through "Z" and the punctuation symbols period "." and comma ",".

Figure 7:
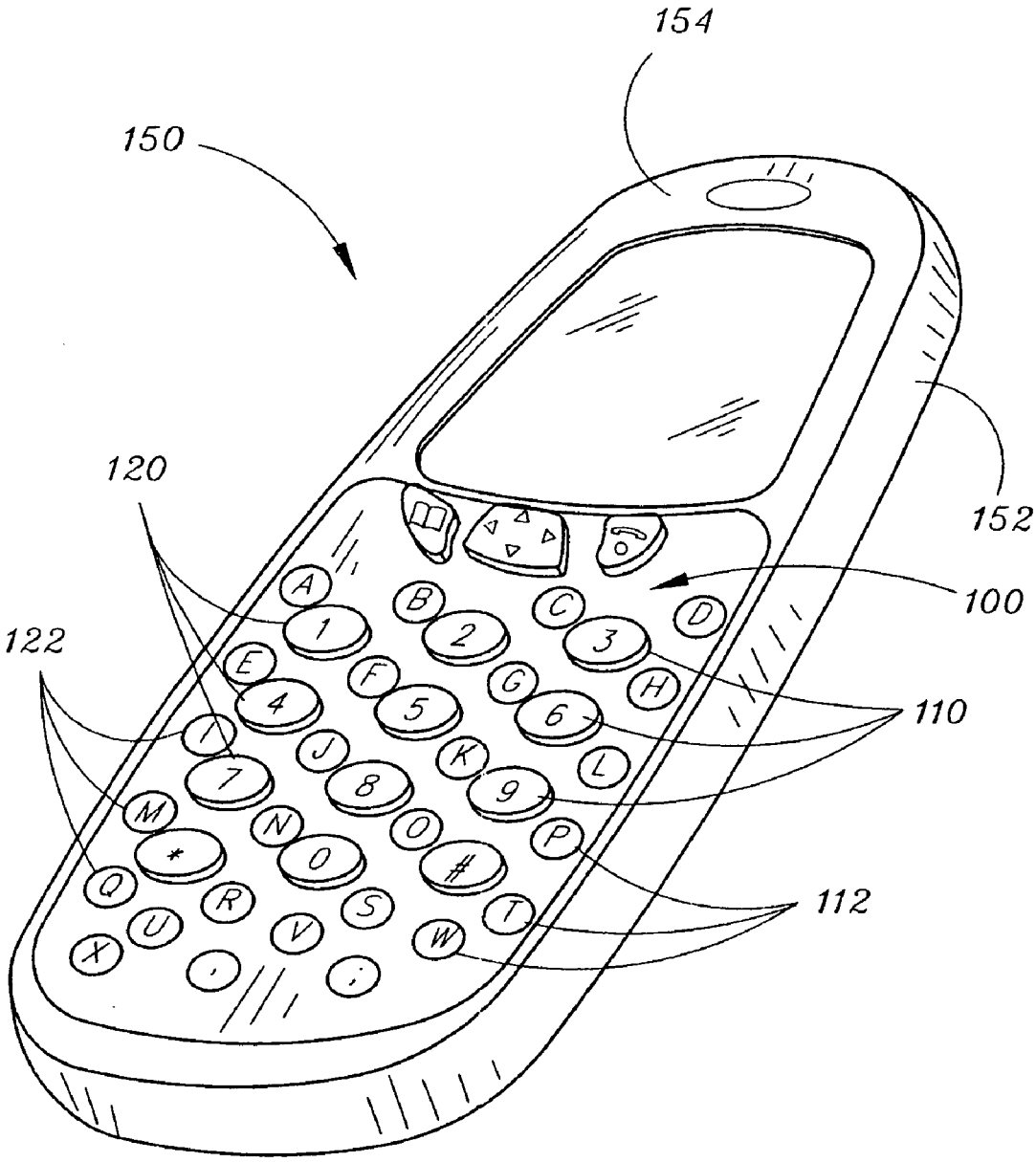
FIG. 7 is an isometric view of the hand-held electronic device illustrated in FIG. 6, wherein a first set of keys is raised above a second set of keys.
Figure 8:
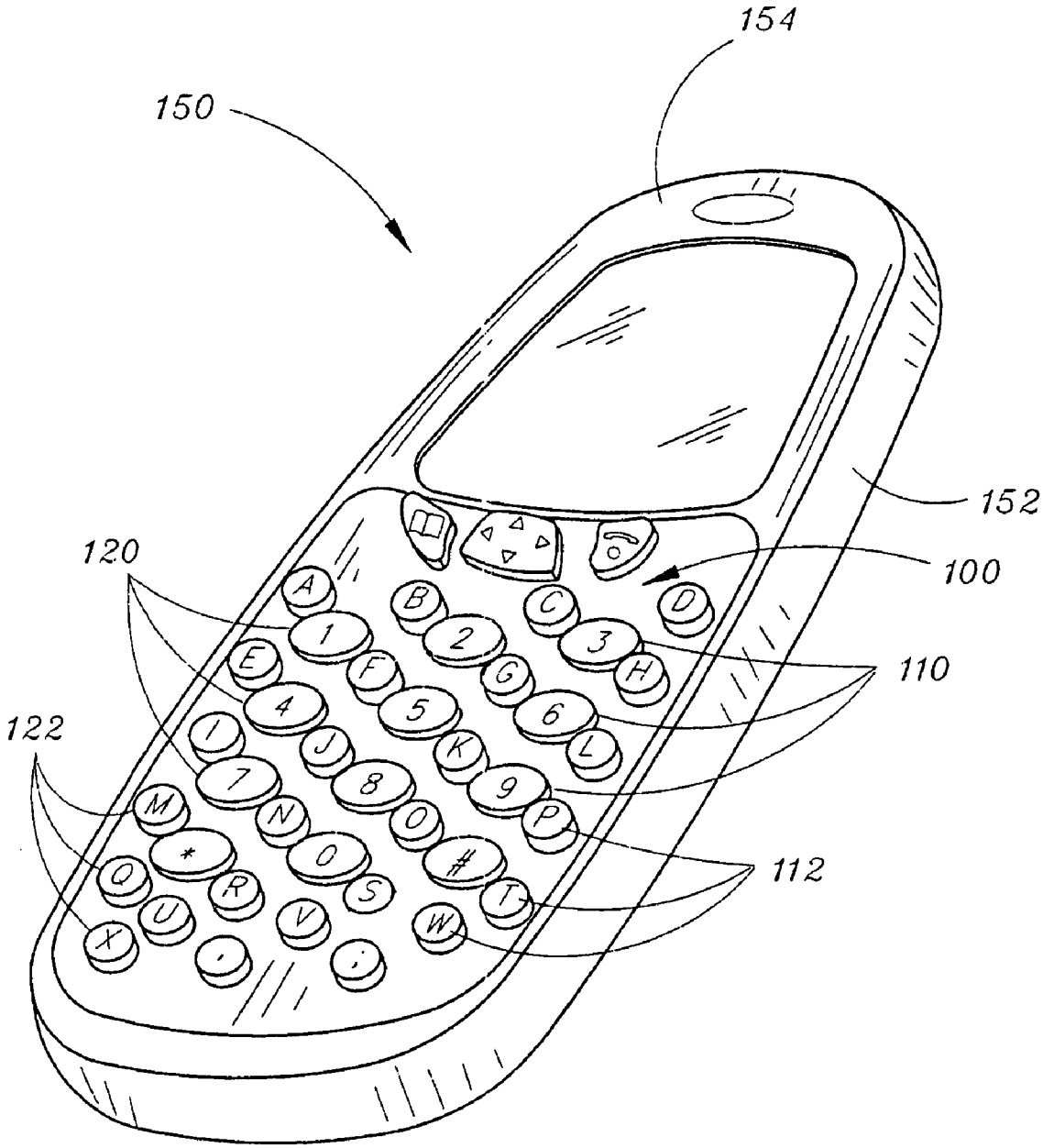
FIG. 8 is an isometric view of the hand-held electronic device illustrated in FIG. 6, wherein the second set of keys is raised above the first set of keys.
Figure 9:
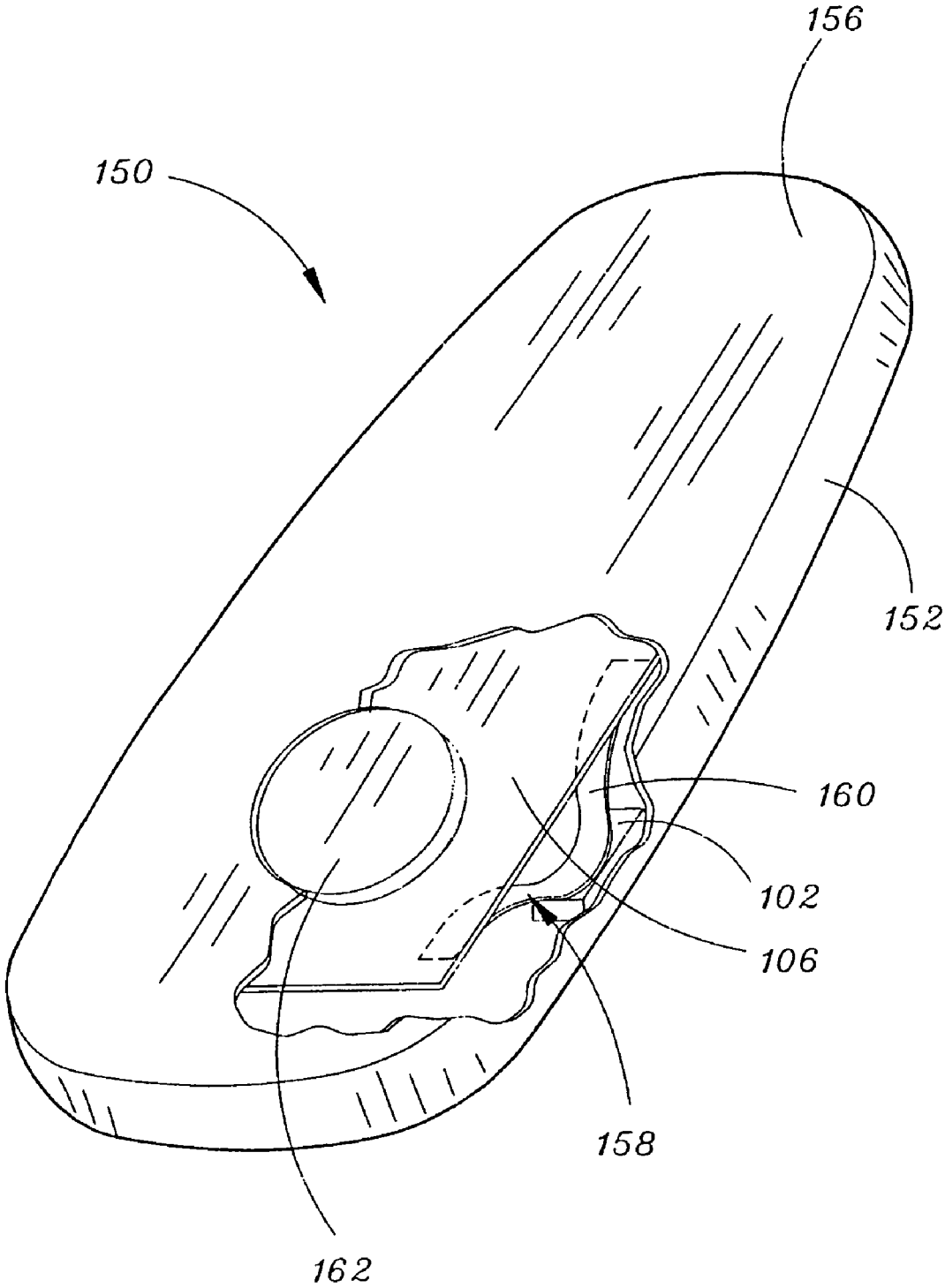
FIG. 9 is a partial cross-sectional isometric view of the hand-held electronic device illustrated in FIG. 6, showing an exemplary actuator assembly including a spring for biasing the second set of keys into the position illustrated in FIG. 7 and a shift key for biasing the second set of keys into the position illustrated in FIG. 8.

As shown in FIGS. 7 and 8, the relative heights of the set of first keys 120 and the set of second keys 122 may be varied as described in the discussion of FIGS. 2 through 5. For instance, as illustrated in FIG. 7, the set of first keys 120 may be positioned above the set of second keys 122 (e.g., by moving the second circuit board 106 and key mat 132 downward, away from the first circuit board 102, as shown in FIG. 4). In this manner, the numeric keys of the set of first keys 120 are more easily accessed for inputting numeric information, while the alphabetic keys of the set of second keys 122 are recessed to prevent inadvertent actuation.

Similarly, as shown in FIG. 8, the set of first keys 120 may be positioned below the second set of keys 122 (e.g., by moving the second circuit board 106 and key mat 132 upward, toward the first circuit board 102, as shown in FIG. 5, for inputting alphabetical information.

An actuator assembly 158 may be coupled to the second circuit board 106 for raising and lowering the set of second keys 122 with respect to the set of first keys 120. For example, in exemplary embodiments, the actuator assembly 158 may be coupled to the second circuit board 106 for moving the second circuit board 106 and key mat 132 toward or away from the first circuit board 102, in the manner illustrated in FIGS. 4 and 5. In the embodiment illustrated in FIG. 9, the actuator assembly 158 includes a spring assembly 160 for biasing the second circuit board 106 away from the first circuit board 102 (e.g., for biasing the second circuit board 106 to the second position as illustrated in FIG. 4). A shift key or button 162, which is positioned in the rear face 156 of the housing 152 in the embodiment illustrated, is coupled to the second circuit board 106. Depressing the shift key 162 overcomes the spring force biasing the second circuit board 106 away from the first circuit board 102, moving the second circuit board 106 toward the first circuit board 102 (e.g., moving the second circuit board 106 and key mat 132 from the second to the first or third positions as illustrated in FIGS. 2 and 5) and shifting the set of second keys 122 upward. Releasing the shift key 162 allows the spring assembly 160 to again bias the second circuit board 106 away from the first circuit board 102 (e.g., to bias the second circuit board 106 and key mat 132 to the second position as shown in FIG. 4), shifting the set of second keys 122 downward. A shift lock mechanism may be provided for holding the second circuit board 106 in any of the first, second and third positions as shown in FIGS. 2, 4 and 5, or, alternatively, other positions there bet. The operator may engage the shift lock mechanism while using the keypad 100 if it is not desirable to press and hold the shift key 162 while inputting information via the keypad 100, for example, for an extended period of time.

Those of skill in the art will appreciate that various other actuator mechanisms may be devised for shifting the second 122 and or first keys 120 without departing from the scope and intent of the present invention. Moreover, while the mobile telephone 150 illustrated in FIGS. 6 through 9 employs a keypad 100 including two sets of keys (i.e., first keys 120 and second keys 122), those of skill in the art will appreciate that the keypad 100 may include more or fewer sets of keys 120 and 122 without departing from the scope and intent of the present invention. For example, the keypad 100 may include only one set of keys 120 and 122 arranged as described in the discussion of FIG. 1. Additionally, other keys, such as a third set of keys, may be provided. Additionally, the sets of keys 120 and 122 may comprise a wide variety of keys, including but not limited to, include alphabetic keys, symbol keys, keys for entering common commands, keys for selecting menus to be displayed by the display, and the like. For example, the set of second keys 122 may alternatively employ a QWERTY keyboard key arrangement or a Dvorak keyboard key arrangement instead of the alphabetic arrangement illustrated. Further, the first set of keys 120 and/or the second set of keys 122 may provide non-alphabetic keys such as function keys, keys for controlling gaming functions, keys for controlling Internet browser functions, keys for controlling recording and/or playback of media (e.g., music and video), a second numeric keypad, or the like, in addition to or in place of the alphanumeric keys illustrated.

The mobile telephone 150 may further include components for providing wireless communication of voice and/or data information with external sources such as a base station, a cellular communication system tower, another mobile communication device, or the like. For example, the mobile telephone 150 may comprise internal components including a processing system, memory, a transceiver assembly including a transmitter and receiver or transceiver, an antenna, a data card reader for receiving a data card (e.g., a subscriber identification module (SIM) card or a user identification module (UIM) card), a speaker or earpiece assembly, a microphone, a power source such as a battery, and the like. Additionally, it is contemplated that the mobile telephone 150 may provide functions other than telephony. For example, the mobile telephone 150 may provide functions common to hand held computers or personal digital assistants, portable gaming devices, or the like. In such embodiments, the mobile telephone may further include a suitable processing system, extended memory, a touch screen overlaying display for tactile input of data, or the like.

In FIGS. 6 through 9, the mobile telephone 150 illustrated is generally shown in "brick" form with most ornate features eliminated. However, those of ordinary skill in the art will recognize that mobile telephones 150 in accordance with the present invention are not limited to the specific configurations disclosed herein, but instead may employ form factors having other ornamental or functional design features without departing from the scope and intent of the present invention. Moreover, it is contemplated that the present invention may be implemented in other types of hand-held electronic devices, including, but not limited to, mobile telephones having forms other than those specifically illustrated, Personal Digital Assistants (PDA's), hand-held gaming devices, and the like. Further, it is contemplated that the present invention may be implemented as an external device for communicatively coupling with an electronic device, such as a computer keyboard or the like.

It is believed that the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A keypad, comprising:

a first circuit board including a first circuit, the first circuit board laving an aperture formed there through;

a first key assembly for providing input to the first circuit when the first key assembly is pressed;

a second circuit board including a second circuit, the second circuit board disposed adjacent to the first circuit board;

a second key assembly for providing input to the second circuit when the second key assembly is pressed; and a keymat including the first key assembly and the second key assembly, wherein the second key assembly extends through the aperture formed in the first circuit board for providing input to the second circuit.

2. The keypad as claimed in claim 1, further comprising:

a first dome disposed over the first circuit board, the first dome for being compressed by the first key assembly for providing input to the first circuit; and a second dome disposed over the second circuit board, the second dome for being compressed by the second key assembly for providing input to the second circuit.

3. The keypad as claimed in claim 2, wherein the first key assembly comprises a first key and a first stalk coupled to the first key, the first stalk engaging the first dome for compressing the first dome when the first key is pressed, and the second key assembly comprises a second key and a second stalk coupled to the second key, the second stalk extending through the aperture formed in the first circuit board for compressing the second dome when the second key is pressed.

4. The keypad as claimed in claim 3, wherein at least one of the first key and the second key has a first diameter and a corresponding one of the first dome and the second dome has a second diameter, the second diameter being greater than the first diameter.

5. The keypad as claimed in claim 4, wherein the first key has a first footprint and the second key has a second footprint, and at least one of the first dome extends into the second footprint and the second dome extends into the first footprint.

6. The keypad as claimed in claim 3, wherein the second circuit board is movable between a first position relative to the first circuit board for positioning the second key at first height relative to the first key and a second position relative to the first circuit board for positioning the second key at a second height relative to the first key.

7. The keypad as claimed in claim 6, wherein the first key has a relative height and the first height is greater than the relative height of the first key and the second height is less than the relative height of the first key.

8. The keypad as claimed in claim 2, wherein the first and second domes comprise an electrically conductive material so that compression of the first dome completes the first circuit and compression of the second dome completes the second circuit.

9. A hand-held electronic device, comprising;

a housing;

a keypad disposed in the housing, the keypad including:

a first circuit board including a first circuit, the first circuit board having an aperture formed there through;

a first key assembly including a first key, the key assembly for providing input to the first circuit when the first key is pressed;

a second circuit board disposed beneath to the first circuit board, the second circuit board including a second circuit; and a second key assembly including a second key, the second key assembly for providing input to the second circuit when the second key is pressed, wherein the second key assembly extends through the aperture formed in the first circuit board for providing input to the second circuit the second circuit board being movable between a first position relative to the first circuit board for positioning the second key at first height relative to the first key and a second position relative to the first circuit board for positioning the second key at a second height relative to the first key.

10. The hand-held electronic device as claimed in claim 9, further comprising:

a first dome disposed over the first circuit board, the first dome for being compressed by the first key assembly for providing input to the first circuit; and a second dome disposed over the second circuit board, the second dome for being compressed by the second key assembly for providing input to the second circuit.

11. The hand-held electronic device as claimed in claim 10, wherein the first key assembly comprises a first stalk coupled to the first key, the first stalk engaging the first dome for compressing the first dome when the first key is pressed, and the second key assembly comprises a second stalk coupled to the second key, the second stalk extending through the aperture formed in the first circuit board for compressing the second data when the second key is pressed.

12. The hand-held electronic device as claimed in claim 11, wherein the first key has a relative height and the first height is greater than the relative height of the first key and the second height is less than the relative height of the first key.

13. The hand-held electronic device as claimed in claim 12, further comprising an actuator assembly coupled to the second circuit board for moving the second circuit board between the first and second positions.

14. A mobile telephone, comprising:

a housing;

a keypad disposed in the housing, the keypad including:

a first circuit board including a first circuit, the first circuit board having an aperture formed there through;

a first key assembly including a first key, the key assembly for providing input to the first circuit when the first key is pressed;

a second circuit board disposed beneath to the first circuit board, the second circuit board including a second circuit; and a second key assembly including a second key, the second key assembly for providing input to the second circuit when the second key is pressed, wherein the second key assembly extends through the aperture formed in the first circuit board for providing input to the second circuit, the second circuit board being movable between a first position relative to the first circuit board for positioning the second key at first height relative to the first key and a second position relative to the first circuit board for positioning the second key at a second height relative to the first key.

15. The keypad as claimed in claim 14, further comprising:

a first dome disposed over the first circuit board, the first dome for being compressed by the first key assembly for providing input to the first circuit; and a second dome disposed over the second circuit board, the second dome for being compressed by the second key assembly for providing input to the second circuit.

16. The keypad as claimed in claim 15, wherein the first key assembly comprises a first stalk coupled to the first key, the first stalk engaging the first dome for compressing the first dome when the first key is pressed and the second key assembly comprises a second stalk coupled to the second key, the second stalk extending through the aperture formed in the first circuit board for compressing the second dome when the second key is pressed.

17. A keypad, comprising:

a first circuit board including a first circuit, the first circuit board having an aperture formed there through;

a first keymat including a first key assembly for providing input to the first circuit when the first key assembly is pressed;

a second circuit board including a second circuit, the second circuit board disposed adjacent to the first circuit board; and a second keymat including a second key assembly for providing input to the second circuit when the second key assembly is pressed, wherein the second key assembly extends through the first keymat and the aperture formed in the first circuit board for providing input to the second circuit.

18. The keypad as claimed in claim 17, further comprising:

a first dome disposed over the first circuit board, the first dome for being compressed by the first key assembly for providing input to the first circuit; and a second dome disposed over the second circuit board, the second dome for being compressed by the second key assembly for providing input to the second circuit.

19. The keypad as claimed in claim 18, wherein the first key assembly comprises a first key and a first stalk coupled to the first key, the first stalk engaging the first dome for compressing the first dome when the first key is pressed, and the second key assembly comprises a second key and a second stalk coupled to the second key, the second stalk extending through the aperture formed in the first circuit board for compressing the second dome when the second key is pressed.

20. The keypad as claimed in claim 19, wherein at least one of the first key and the second key has a first diameter and a corresponding one of the first dome and the second dome has a second diameter, the second diameter being greater than the first diameter.

21. The keypad as claimed in claim 20, wherein the first key has a first footprint and the second key has a second footprint, and at least one of the first dome extends into the second footprint and the second dome extends into the first footprint.

22. The keypad as claimed in claim 20, wherein the second circuit board is movable between a first position relative to the first circuit board for positioning the second key at first height relative to the first key and a second position relative to the first circuit board for positioning the second key at a second height relative to the first key.

23. The keypad as claimed in claim 22, wherein the first key has a relative height and the first height is greater than the relative height of the first key and the second height is less than the relative height of the first key.

* * * * *